US010648372B2

(12) United States Patent
Hirschmann et al.

(10) Patent No.: US 10,648,372 B2
(45) Date of Patent: May 12, 2020

(54) SLIDING CAM SYSTEM

(71) Applicant: MAN Truck & Bus AG, München (DE)

(72) Inventors: Steffen Hirschmann, Neustadt An Der Aisch (DE); Jens Dietrich, Heilsbronn (DE)

(73) Assignee: MAN TRUCK & BUS AG, München (DE)

( * ) Notice: Subject to any disclaimer, the term of this patent is extended or adjusted under 35 U.S.C. 154(b) by 0 days.

(21) Appl. No.: 16/045,479

(22) Filed: Jul. 25, 2018

(65) Prior Publication Data

US 2019/0032521 A1 Jan. 31, 2019

(30) Foreign Application Priority Data

Jul. 25, 2017 (DE) ..... 10 2017 116 820

(51) Int. Cl.
*F01L 1/34* (2006.01)
*F01L 1/26* (2006.01)
(Continued)

(52) U.S. Cl.
CPC ..... *F01L 1/267* (2013.01); *F01L 1/047* (2013.01); *F01L 13/0036* (2013.01); *F01L 1/181* (2013.01); *F01L 1/26* (2013.01); *F01L 2013/0052* (2013.01); *F01L 2013/101* (2013.01); *F01L 2013/103* (2013.01); *F01L 2013/105* (2013.01); *F01L 2013/106* (2013.01); *F01L 2105/00* (2013.01)

(58) Field of Classification Search
CPC ..... F01L 1/267; F01L 13/0036; F01L 1/047; F01L 1/181; F01L 2013/105
USPC ..... 123/90.12, 90.13, 90.16, 90.18
See application file for complete search history.

(56) References Cited

U.S. PATENT DOCUMENTS 8,307,797 B2 * 11/2012 Meintschel ..... F01L 1/047 123/90.18

FOREIGN PATENT DOCUMENTS

DE 19611641 C1 6/1997
DE 19908286 A1 8/2000
(Continued)

OTHER PUBLICATIONS

European Office Action issued in European Patent Application No. 18181090.4 dated Dec. 20, 2019, 3 pages. No english translation available.

*Primary Examiner* — Ching Chang
(74) *Attorney, Agent, or Firm* — Weber Rosselli & Cannon LLP

(57) ABSTRACT

A sliding cam system for an internal combustion engine. The sliding cam system includes a cam shaft and a cam carrier, arranged rotationally fixedly and axially movably on the cam shaft. The cam carrier including a first shifting gate and a second shifting gate. The sliding cam system includes a first actuator with an element able to move along a longitudinal axis of the cam shaft, especially a pin, which can be brought into contact with the first shifting gate for the axial movement of the cam carrier in a first direction. The sliding cam system includes a second actuator with an element able to move along the longitudinal axis of the cam shaft, especially a pin, which can be brought into contact with the second shifting gate for the axial movement of the cam carrier in a second direction which is opposite to the first direction.

17 Claims, 10 Drawing Sheets

(51) Int. Cl.

| | |
|---|---|
| ***F01L 13/00*** | (2006.01) |
| ***F01L 1/047*** | (2006.01) |
| *F01L 1/18* | (2006.01) |

(56) References Cited

FOREIGN PATENT DOCUMENTS

| | | | |
|---|---|---|---|
| DE | 102010022708 | A1 | 12/2011 |
| DE | 102010022709 | A1 | 12/2011 |
| DE | 102011050484 | A1 | 11/2012 |
| JP | S5890338 | U | 6/1983 |
| JP | S6075603 | U | 5/1985 |
| JP | 2013019307 | A | 1/2013 |
| JP | 2013060823 | A | 4/2013 |
| JP | 2014152654 | A | 8/2014 |
| WO | 2015163252 | A1 | 10/2015 |

* cited by examiner

SLIDING CAM SYSTEM

BACKGROUND

The present disclosure relates to a sliding cam system for an internal combustion engine.

Valve-controlled internal combustion engines comprise one or more controllable admission and exhaust valves for each cylinder. Variable valve trains enable a flexible actuating of the valves for changing the opening time, closing time, and/or valve lift. In this way, the engine operation can be adapted to a specific load situation, for example. For example, a variable valve train can be realized by a so-called sliding cam system.

From DE 196 11 641 C1 there is known an example of such a sliding cam system, making possible the activation of a gas exchange valve with several different lift curves. For this purpose, a sliding cam is mounted on the cam shaft in a rotationally fixed but axially movable manner, having at least one cam section with several cam tracks, having a lift contour in which an actuator is inserted in the form of a pin, radially from the outside, in order to generate an axial displacement of the sliding cam. Thanks to the axial displacement of the sliding cam, a different valve lift is established for the particular gas exchange valve. The sliding cam, after its axial displacement relative to the cam shaft, is locked in its relative axial position on the cam shaft in that at least one spring-loaded detent ball, which is received and mounted in the cam shaft, engages in at least one detent groove in dependence on the relative axial position.

The sliding cam system may take up significant design space. In particular, an arrangement of the actuators for the moving of a cam carrier (sliding cam) may represent a challenge when space is tight. Typically, the actuators are fastened to a frame connected to the cylinder head or cylinder head cover.

From DE 10 2011 050 484 A1 there is known an internal combustion engine with multiple cylinders, a cylinder head, and a cylinder head cover. For the activating of gas exchange valves, there is provided at least one rotary mounted cam shaft with at least one sliding cam able to move axially on the respective cam shaft. The respective sliding cam has at least one gate section with at least one groove. An actuator is provided to bring about an axial displacement of the respective sliding cam. The actuator is mounted in the cylinder head or in the cylinder head cover.

SUMMARY

The present disclosure proposes to solve the problem of providing an improved or alternative sliding cam system having in particular an optimized layout in terms of design space.

The sliding cam system for an internal combustion engine comprises a cam shaft. The sliding cam system comprises a cam carrier, which is arranged rotationally fixedly and axially movably on the cam shaft. The cam carrier comprises a first shifting gate. Preferably, the cam carrier also comprises a second shifting gate. The sliding cam system comprises a first actuator with an element (such as an extending and retracting element) able to move along a longitudinal axis of the cam shaft. The element is configured in particular as a pin. The element can be brought into contact with the first shifting gate for the axial movement of the cam carrier in a first direction. The sliding cam system preferably also comprises a second actuator with an element (such as an extending and retracting element) able to move along the longitudinal axis of the cam shaft. The element is configured in particular as a pin. The element can be brought into contact with the second shifting gate for the axial movement of the cam carrier in a second direction which is opposite to the first direction.

The providing of one or more axially operating actuators enables a space-optimized arrangement of the actuators as compared to systems with radially operating actuators. In particular, the axially operating actuators can be integrated in existing structures along the cam shaft.

When using only one actuator, this actuator may have a dual-action design, for example. In this way, an axial displacement of the cam carrier can be made possible in both directions along the longitudinal axis of the cam shaft. The actuator can move the cam carrier for example in a first direction against an elastic biasing element. In an opposite direction, the actuator can make possible a displacement of the cam carrier by the elastic biasing element due to the retracting of the movable element. It is also possible to use a different mechanism, which in combination with only one actuator enables an axial displacement of the cam carrier between a first axial position and a second axial position.

When using two actuators, the first actuator can move the cam carrier from a second axial position to a first axial position. The second actuator can move the cam carrier from a first axial position to a second axial position. In the first axial position, a first cam of the cam carrier may be in operative connection with at least one gas exchange valve. In the second axial position, a second cam of the cam carrier may be in operative connection with the at least one gas exchange valve.

In an embodiment, the first actuator is received in or on a first bearing block, which supports the cam shaft in a rotating manner. Alternatively or additionally, the second actuator is received in or on a second bearing block, which supports the cam shaft in a rotating manner. In this way, the actuators do not require any separate design space. Instead, the actuators can be integrated directly in already present bearing blocks of the cam shaft with no additional space requirement.

In particular, the first actuator may be fastened on the first bearing block and/or the second actuator may be fastened on the second bearing block.

In addition, a supplying of hydraulic fluid may be accomplished by the bearing blocks to the first actuator and/or to the second actuator. Thus, no additional space is needed for the hydraulic lines either. Likewise, an electrical line for example, and/or a pneumatic line for the first actuator and/or the second actuator can be provided in or on the first and/or second bearing block.

In one embodiment, the first shifting gate and/or the second shifting gate has a steplike configuration. The steplike configuration of the shifting gate can make possible a contacting by the movable elements of the actuators in simple manner. The movable elements of the actuators can press against a shoulder of the respective steplike shifting gate when the cam carrier needs to be displaced.

In another embodiment, the first shifting gate is arranged at a first end of the cam carrier and the second shifting gate is arranged at an opposite second end of the cam carrier. In this way, the travel path of the movable elements can be minimized. The actuators can be arranged directly next to the ends of the cam carrier.

In one exemplary embodiment, the first shifting gate comprises an actuator contact surface, which extends in a circumferential direction about the longitudinal axis of the cam shaft. Alternatively or additionally, the second shifting gate comprises an actuator contact surface which extends in a circumferential direction about the longitudinal axis of the cam shaft. A displacement of the cam carrier can be realized through a contact between the movable elements of the actuators and the corresponding actuator contact surfaces. In addition, in one modification, a dampening of the displacement of the cam carrier can be realized by a contact with the corresponding actuator contact surfaces.

In another exemplary embodiment, the actuator contact surface of the first shifting gate comprises a first ramp and a second ramp. The first ramp of the actuator contact surface of the first shifting gate increases a distance between the first actuator and the actuator contact surface of the first shifting gate relative to a rotary direction of the cam shaft. The second ramp of the actuator contact surface of the first shifting gate decreases a distance between the first actuator and the actuator contact surface of the first shifting gate relative to a rotary direction of the cam shaft.

Alternatively or additionally, the actuator contact surface of the second shifting gate comprises a first ramp and a second ramp. The first ramp of the actuator contact surface of the second shifting gate increases a distance between the second actuator and the actuator contact surface of the second shifting gate relative to a rotary direction of the cam shaft. The second ramp of the actuator contact surface of the second shifting gate decreases a distance between the second actuator and the actuator contact surface of the second shifting gate relative to a rotary direction of the cam shaft.

The ramps make possible a displacement movement of the cam carrier by contact with the movable elements. For example, if the movable element of the first actuator contacts the second ramp of the actuator contact surface of the first shifting gate, the cam carrier will be moved in the first direction, while the cam carrier rotates together with the cam shaft. On the other hand, if the movable element of the second actuator contacts the second ramp of the actuator contact surface of the second shifting gate, the cam carrier will be moved in the second direction, while the cam carrier rotates together with the cam shaft.

In particular, the first and second ramp of the first and second shifting gate may be arranged so that a displacement of the cam carrier is only possible within a base circle area of the cam of the cam carrier.

In one variant embodiment, the first actuator and/or the second actuator is hydraulically, electrically and/or pneumatically operated.

In another variant embodiment, an axial displacement of the cam carrier is dampened hydraulically and/or by an elastic element. The dampening can make possible an arresting (axial securing) of the cam carrier.

In one embodiment, the sliding cam system comprises a first elastic element, which biases the cam carrier in the second direction. Alternatively or additionally, the sliding cam system comprises a second elastic element, which biases the cam carrier in the first direction. The elastic elements enable a dampening of the displacement movement of the cam carrier. For example, if the cam carrier is pushed by the first actuator in the first direction, the first elastic element can dampen the displacement movement of the cam carrier.

In one modification, the first elastic element supports the cam carrier on a bearing block for the rotary mounting of the cam shaft and is mounted rotatably about the longitudinal axis of the cam shaft relative to the bearing block or the cam carrier. Alternatively or additionally, the second elastic element supports the cam carrier on a bearing block for the rotary mounting of the cam shaft and is mounted rotatably about the longitudinal axis of the cam shaft relative to the bearing block or the cam carrier. The bearing blocks of the cam shaft, which are present in any case, may thus be used to support the elastic elements for the dampening of the displacement movement of the cam carrier. The rotary mounting of the elastic elements is provided in order to prevent a grinding of the elastic elements against the cam carrier or bearing block, since the elastic elements in the embodiment either rotate with the cam carrier or are fixed to the bearing block.

In one exemplary embodiment, the sliding cam system comprises a first hydraulic damping cylinder, which is disposed to dampen an axial displacement of the cam carrier in the first direction. Alternatively or additionally, the sliding cam system comprises a second hydraulic damping cylinder, which is disposed to dampen an axial displacement of the cam carrier in the second direction.

In one modification, the sliding cam system further comprises a first throttle, which is arranged downstream from the first hydraulic damping cylinder, and/or a second throttle, which is arranged downstream from the second hydraulic damping cylinder. The throttles can be used to build up a resistance to hydraulic fluid emerging from the hydraulic damping cylinders, whereby a desirable dampening can be realized.

In one variant embodiment, the second actuator dampens an axial displacement of the cam carrier when the first actuator moves the cam carrier axially in the first direction. Alternatively or additionally, the first actuator dampens an axial displacement of the cam carrier when the second actuator moves the cam carrier axially in the second direction. In this way, the dampening functionality can be integrated directly into the actuators.

In another variant embodiment, the second actuator dampens an axial displacement of the cam carrier hydraulically and/or by an elastic element of the second actuator. Alternatively or additionally, the first actuator dampens an axial displacement of the cam carrier hydraulically and/or by an elastic element of the first actuator.

The present disclosure also relates to a variable valve train for an internal combustion engine. The variable valve train comprises a sliding cam system as disclosed herein. The variable valve train comprises at least one gas exchange valve and a force transmission device (such as a tappet, rocker arm or drag lever). The force transmission device in dependence on an axial position of the cam carrier optionally places a first cam of the cam carrier in operative connection with the at least one gas exchange valve or places a second cam of the cam carrier in operative connection with the at least one gas exchange valve.

From another standpoint, the present disclosure also relates to a motor vehicle, especially a utility vehicle, having a sliding cam system as disclosed herein or a variable valve train as disclosed herein. The utility vehicle may be, for example, a bus or a lorry.

The above described embodiments and features of the present disclosure may be combined with each other as desired.

BRIEF SUMMARY OF THE DRAWINGS

Further details and benefits of the present disclosure shall be described below with reference to the enclosed drawings, in which.

DETAILED DESCRIPTION

The embodiments shown in the figures agree with each other at least in part, so that similar or identical parts are given the same reference symbols and reference is also made for their explanation to the description of the other embodiments or figures, in order to avoid repetition.

Figure 1:
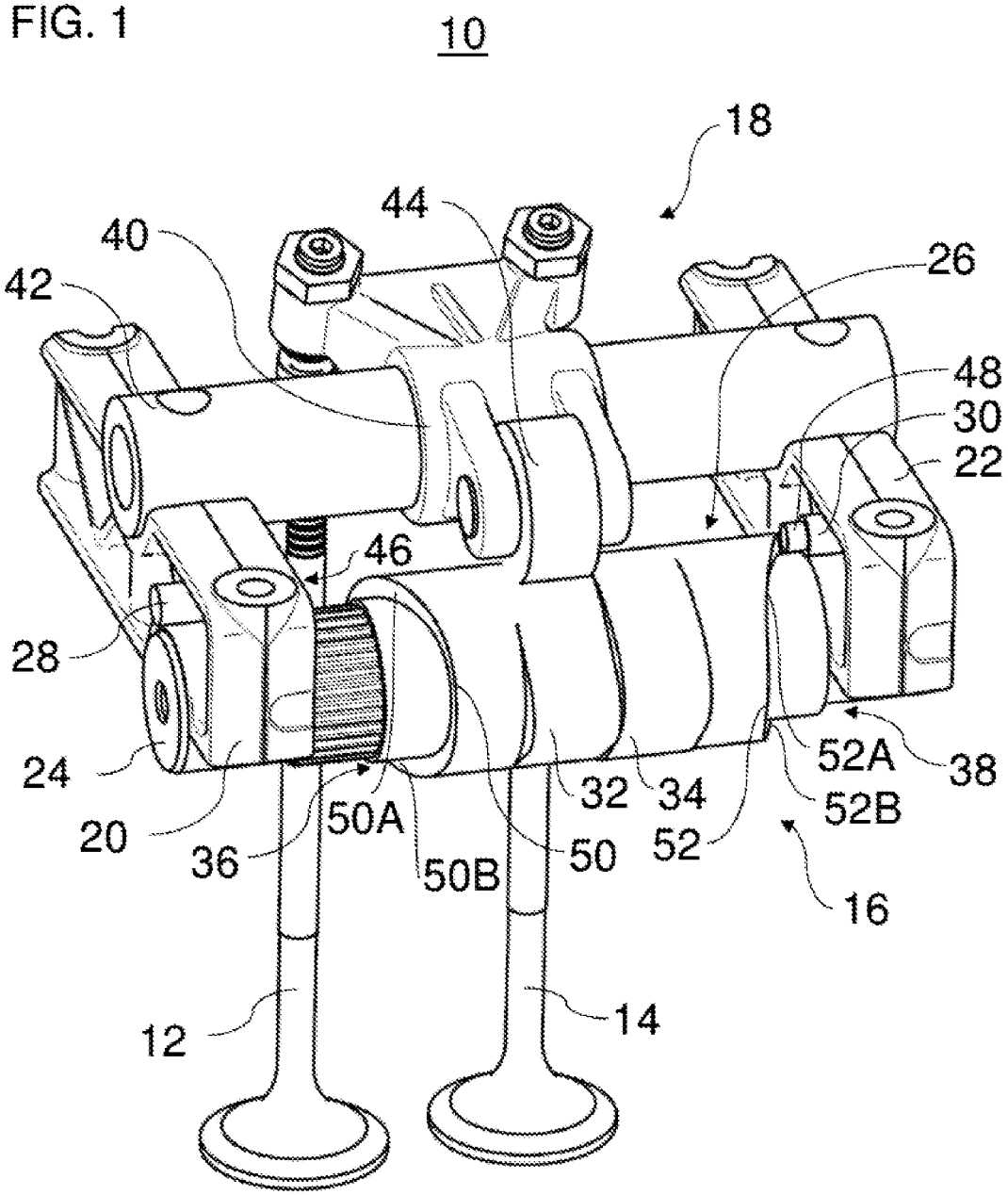
FIG. 1 shows a perspective view of a variable valve train with a sliding cam system.

FIG. 1 shows a variable valve train 10. The variable valve train 10 may for example be part of an internal combustion engine of a utility vehicle, especially a lorry or a bus. The variable valve train 10 comprises a first gas exchange valve 12, a second gas exchange valve 14, a sliding cam system 16, a force transmission device 18, a first bearing block (bearing body) 20 and a second bearing block (bearing body) 22.

The variable valve train 10 serves for adapting an actuation of the gas exchange valves 12, 14. In particular, an opening time, a closing time, and/or a valve lift of the gas exchange valves 12, 14 may be adapted. The gas exchange valves 12, 14 may be admission valves or exhaust valves.

The bearing blocks 20, 22 mount a cam shaft 24 in rotary manner. In addition, the rocker arm axis 42 is fastened to the bearing blocks 20, 22. The bearing blocks 20, 22 for example may be fastened to a fastening frame or a cylinder head of the internal combustion engine. In other embodiments, the cam shaft 24 and the rocker arm axis 42 may be mounted separate from each other, for example.

The sliding cam system 16 comprises the cam shaft 24, a cam carrier 26, a first actuator 28 and a second actuator 30.

The cam carrier 26 is arranged in a rotationally fixed and axially movable manner on the cam shaft 24. The cam carrier 26 comprises a first cam 32, a second cam 34, a first shifting gate 36 and a second shifting gate 38.

The first cam 32 and the second cam 34 are arranged adjacent to one another. The first cam 32 and the second cam 34 have different cam contours. The first cam 32 and the second cam 34 are provided in a middle area of the cam carrier 26. Depending on an axial position of the cam carrier 26 relative to the cam shaft 24, the force transmission device 18 produces an operative connection between the first cam 32 and the gas exchange valves 12, 14 or between the second cam 34 and the gas exchange valves 12, 14.

Specifically, the force transmission device 18 comprises a rocker arm 40 and a rocker arm axis 42. The rocker arm 40, through a cam follower 44 and depending on the axial position of the cam carrier 26, follows a cam contour of the first cam 32 or of the second cam 34. The cam follower 44 is configured as a rotary mounted roller. The rocker arm 40 is pivoted about the rocker arm axis 42 in a rotary manner. In a valve lift area of the cam 32 or 34, the gas exchange valves 12, 14 are activated accordingly via the rocker arm 40. In other embodiments, the force transmission device 18 may have for example a drag lever or tappet.

In the example represented in FIG. 1, the cam carrier 26 is in a first axial position. In the first axial position, the force transmission device 18 produces an operative connection between the first cam 32 and the gas exchange valves 12, 14. The cam carrier 26 can be moved into a second axial position (to the left in FIG. 1). In the second axial position, the force transmission device 18 places the second cam 34 in operative connection with the gas exchange valves 12, 14. The cam carrier (sliding cam) 26 can be moved along the axial direction of the cam shaft 24 by interaction of the first actuator 28, the second actuator 30, the first shifting gate 36 and the second shifting gate 38.

The first actuator 28 is accommodated and secured in the first bearing block 20. The second actuator 30 is accommodated and secured in the second bearing block 22. The fastening and accommodating of the actuators 28, 30 in the bearing blocks 20, 22 is favourable for space reasons. No separate design space need be provided for the actuators 28, 30.

The first shifting gate 36 and the second shifting gate 38 are arranged at opposite axial ends of the cam carrier 26. The first shifting gate 36 interacts with the first actuator 28 to move the cam carrier 26 from the second axial position to the first axial position. The cam carrier 26 can be moved by the first actuator 28 and the first shifting gate 36 in a first direction. The second shifting gate 38 interacts with the second actuator 30 to move the cam carrier 26 from the first axial position to the second axial position. The cam carrier 26 can be moved by the second actuator 30 and the second shifting gate 38 in a second direction. The second direction is oriented opposite to the first direction. The first and second direction extend parallel to a longitudinal axis of the cam shaft 24.

Each actuator 28, 30 has a movable pin 46, 48. The pin 46 of the first actuator 28 is concealed in FIG. 1 by the first bearing block 20. The pins 46, 48 are able to move in an axial direction of the cam shaft 24. Instead of the pins 46, 48, other movable elements may also be used for the moving of the cam carrier 26.

The first shifting gate 36 and the second shifting gate 38 have a steplike shape. Specifically, the shifting gates 36, 38 each comprise an actuator contact surface 50, 52. The actuator contact surfaces 50, 52 extend in a circumferential direction about the longitudinal axis of the cam shaft 24. The actuator contact surface 50 comprises a first ramp 50A and a second ramp 50B. The first ramp 50A increases a distance between the first actuator 28 and the actuator contact surface 50 in regard to a rotary direction of the cam shaft 24. The second ramp 50B decreases a distance between the first actuator 28 and the actuator contact surface 50 in regard to a rotary direction of the cam shaft 24. Likewise, the actuator contact surface 52 comprises a first ramp 52A and a second ramp 52B.

The first ramp 52A increases a distance between the second actuator 30 and the actuator contact surface 52 in regard to a rotary direction of the cam shaft 24. The second ramp 52B decreases a distance between the second actuator 30 and the actuator contact surface 52 in regard to a rotary direction of the cam shaft 24. In other words, in the area of the first ramps 50A, 52A the actuator contact surfaces 50, 52 extend in a spiral (helix) in a direction toward each other in regard to a rotary direction of the cam shaft 24. In the area of the second ramps 50B, 52B the actuator contact surfaces 50, 52 extend in a spiral (helix) in an opposite direction in regard to a rotary direction of the cam shaft 24.

In order to move the cam carrier 26 from the second axial position to the first axial position, the pin 46 of the first actuator 28 is extended. The pin 46 of the first actuator 28 is extended such that the pin 46 is entirely extended when the cam carrier 26 reaches a rotary position in which a beginning of the second ramp 50B passes the pin 46 by rotation of the cam shaft 24. The pin 46 may for example be extended while the first ramp 50A passes the pin 46 on account of the turning of the cam shaft 24. By means of the ramp 50B, the extended pin 46 pushes the cam carrier 26 from the second axial position to the first axial position.

The displacement of the cam carrier 26 from the first axial position to the second axial position occurs in similar fashion by the pin 48 of the second actuator 30. By means of the ramp 52B of the actuator contact surface 52, the extended pin 48 pushes the cam carrier 26 into the second axial position.

The sliding cam system 16 may additionally have an arresting device (not shown). The arresting device may be configured such that it axially secures the cam carrier 26 in the first axial position and the second axial position. For this purpose, the arresting device may comprise for example an elastically biased blocking body. The blocking body in the first axial position of the cam carrier 26 may engage in a first recess of the cam carrier and in the second axial position of the cam carrier 26 it may engage in a second recess of the cam carrier 26. The arresting device may be provided for example in the cam shaft 24.

The actuators 28 and 30 may be hydraulically operated actuators, for example. In the following description, exemplary embodiments are described for hydraulic systems to activate the actuators 28 and 30.

Figure 2:
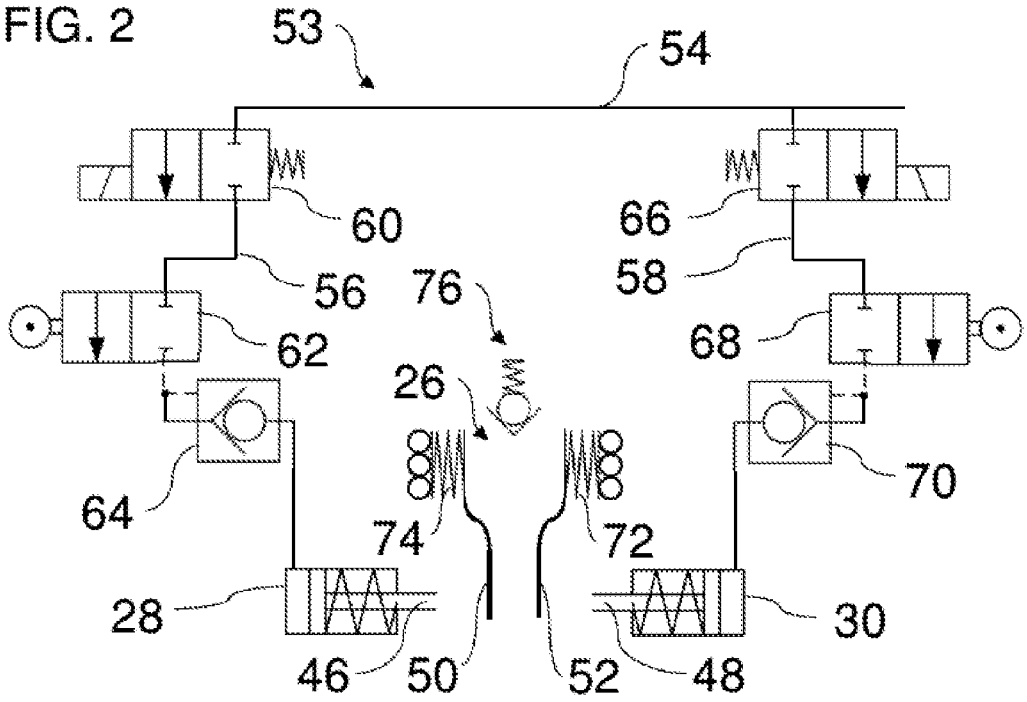
FIG. 2 shows a diagrammatic representation of one embodiment of the sliding cam system.

FIG. 2 shows a hydraulic system 53. The hydraulic system 53 comprises a main hydraulic line 54, a first connection line 56 and a second connection line 58.

The first actuator 28 is connected by the first connection line 56 to the main hydraulic line 54. The second actuator 30 is connected by the second connection line 58 to the main hydraulic line 54. A first electrically operated 2-way valve 60, a first mechanically operated 2-way valve 62 and a first control valve 64 are arranged in the first connection line 58 to control an incoming flow of hydraulic fluid to the first actuator 28. A second electrically operated 2-way valve 66, a second mechanically operated 2-way valve 68 and a second control valve 70 are arranged in the second connection line 58 to control an incoming flow of hydraulic fluid to the second actuator 30.

For the displacement of the cam carrier 26 by the first actuator 28, at first an electrical releasing occurs by the first electrically operated 2-way valve 60. The first electrically operated 2-way valve 60 produces a fluidic connection between the main hydraulic line 54 and the first mechanically operated 2-way valve 62. By means of the first mechanically operated 2-way valve 62, it may be ensured for example that the switching occurs only within a common cam base circle of the cams 32, 34 (see FIG. 1). Within the cam base circle, the mechanically operated 2-way valve 62 produces a fluidic connection between the main hydraulic line 54 and the first actuator 28 across the released first electrically operated 2-way valve 60. The hydraulic fluid passes the first control valve 64 and causes an extending of the pin 46 of the first actuator 28. The pin 46 of the first actuator 28 touches the actuator contact surface 50 of the first shifting gate 36 and pushes the cam carrier 26 into the first axial position. Hereupon, the cam carrier 26 rotates in a circumferential direction about the longitudinal axis of the cam shaft 24 (see FIG. 1). The first control valve 64 is designed as a controllable check valve. The first control valve 64 prevents a back flow of the hydraulic fluid from the first actuator 28 as long as a control pressure is present from the first connection line 56. For example, hydraulic fluid draining from the first actuator 28 may be discharged into a hydraulic fluid space of the internal combustion engine, not shown. The hydraulic fluid space may be for example an oil space of the internal combustion engine.

For the displacement of the cam carrier 26 by the second actuator 30, once again an electrical releasing of the second electrically operated 2-way valve 66 occurs at first. Within the cam base circle, the second mechanically operated 2-way valve 68 can produce a fluidic connection between the second actuator 30 and the main hydraulic line 54. The pin 48 of the second actuator 30 extends, touches the actuator contact surfaces 52 and pushes the cam carrier 26 into the second axial position while the cam carrier 26 is turning.

For the dampening of the axial displacement of the cam carrier 26, elastic elements 72, 74 are provided, such as springs. The elastic elements 72, 74 brace the cam carrier 26 against the first bearing block 20 and the second bearing block 22. For this, the elastic elements 72, 74 are mounted, for example by ball bearings, in rotatable manner on the corresponding bearing block 20, 22. Alternatively, the elastic elements 72, 74 could also be secured to the bearing blocks 20, 22 and be rotably connected, for example by ball bearings, to the cam carrier 26.

In FIG. 2, the arresting device for the cam carrier 26 described with reference to FIG. 1 is additionally symbolically denoted by a reference number 76.

Figure 3:
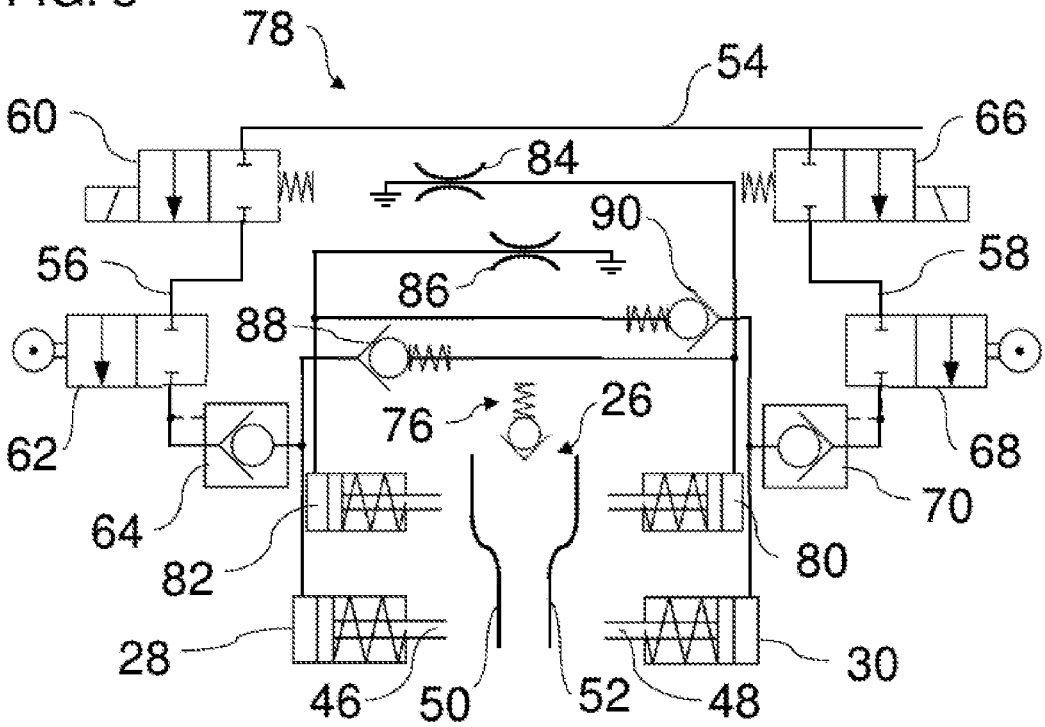
FIG. 3 shows a diagrammatic representation of another embodiment of the sliding cam system.

FIG. 3 shows another hydraulic system 78. The hydraulic system 78 differs from the hydraulic system 53 of FIG. 2 in particular in the dampening of the axial displacement of the cam carrier 26. For the dampening of the axial displacement of the cam carrier 26, the hydraulic system 78 comprises a first damping cylinder 80 and a second damping cylinder 82.

A piston of the first damping cylinder 80 extends when the pin 46 of the first actuator 28 extends. If the cam carrier 26 during the axial displacement toward the first axial position finally contacts the piston of the first damping cylinder 80, the piston of the first damping cylinder 80 will be pushed in. Hydraulic fluid will be ejected from the first damping cylinder 80. The hydraulic fluid is taken across a first throttle 84 to a hydraulic fluid space of the internal combustion engine. The ejecting of the hydraulic fluid dampens the axial movement of the cam carrier 26.

In a similar manner, a piston of the second damping cylinder 82 extends when the pin 48 of the second actuator 30 extends. Hydraulic fluid will be ejected from the second damping cylinder 82 when the piston of the second damping cylinder 82 is pushed in by the cam carrier 26. The ejected hydraulic fluid passes through the second throttle 86 and arrives at the hydraulic fluid space of the internal combustion engine.

When hydraulic fluid is ejected from the first damping cylinder 80, a first check valve 88 prevents the hydraulic fluid being taken from the first damping cylinder 80 to the first actuator 28. Likewise, a second check valve 90 prevents the hydraulic fluid ejected from the second damping cylinder 82 being taken to the second actuator 30.

The first damping cylinder 80 dampens an axial displacement of the cam carrier 26 to the second axial position. The second damping cylinder 82 dampens an axial displacement of the cam carrier 26 to the first axial position. The throttles 84, 86 constitute a resistance to the hydraulic fluid emerging from the corresponding damping cylinder 80, 82, so that a desired dampening is made possible.

The benefit of using the damping cylinders 80, 82 as compared to the use of the elastic elements 72, 74 (cf. FIG. 2) is in particular that no elastic restoring force is realized, but only a dampening due to the damping cylinders 80, 82.

Figure 4:
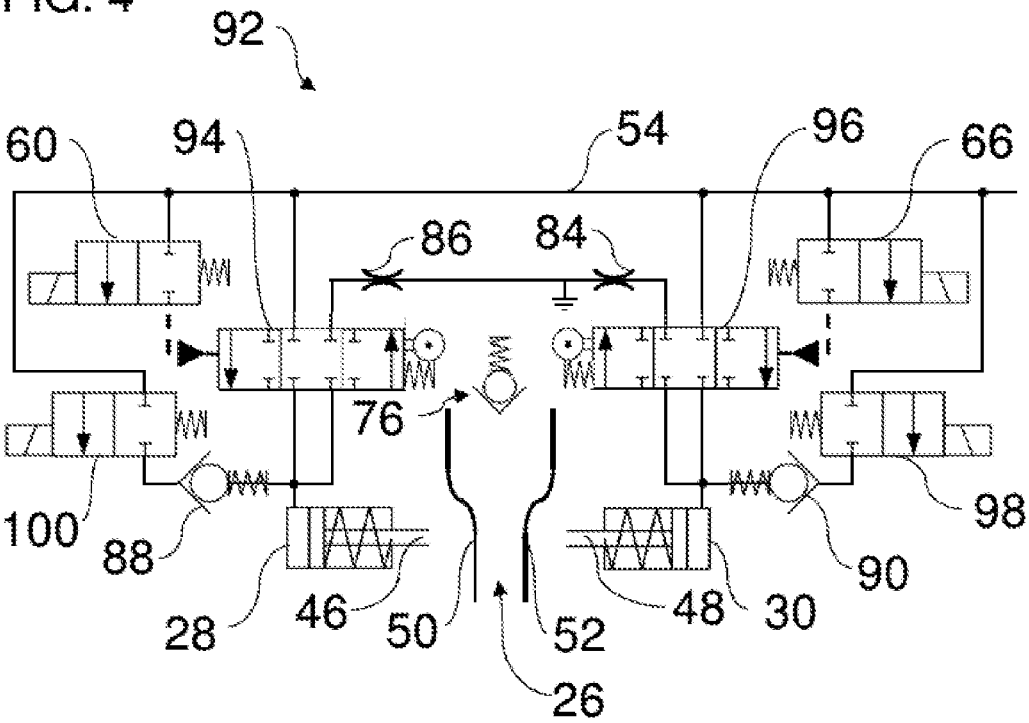
FIG. 4 shows a diagrammatic representation of yet another embodiment of the sliding cam system.

FIG. 4 shows another hydraulic system 92. The hydraulic system 92 differs from the hydraulic system 78 of FIG. 3 in particular in that no separate damping cylinders are provided. The dampening of the axial displacement of the cam carrier 26 is carried out instead by the actuators 28, 30 themselves.

Specifically, the hydraulic system 92 comprises a first mechanically operated 4-way valve 94 and a second mechanically operated 4-way valve 96. The first mechanically operated 4-way valve 94 is actuated by the first electrically operated 2-way valve 60. The second mechanically operated 4-way valve 96 is actuated by the second electrically operated 2-way valve 66. In addition, the hydraulic system 92 has a third electrically operated 2-way valve 98 and a fourth electrically operated 2-way valve 100.

For the axial displacement of the cam carrier 26 to the first axial position, the first mechanically operated 4-way valve 94 is actuated by the first electrically operated 2-way valve 60. The first mechanically operated 4-way valve 94 produces a fluidic connection between the main hydraulic line 54 and the first actuator 28. The pin 46 of the first actuator 28 is extended. The cam carrier 26 is displaced in a direction toward the first axial position.

For the dampening of the axial displacement of the cam carrier 26 during a displacement toward the first axial position, the third electrically operated 2-way valve 98 produces a fluidic connection between the second actuator 30 and the main hydraulic line 54. The extended pin 48 of the second actuator 30 contacts the cam carrier 26 while the cam carrier 26 is moving toward the first axial position. The pin 48 is pushed into the second actuator 30. Hydraulic fluid is ejected from the second actuator 30. The ejected hydraulic fluid goes across the properly adjusted second mechanically operated 4-way valve 96 through the first throttle 84 to the hydraulic fluid space of the internal combustion engine. The ejecting of the hydraulic fluid dampens the displacement movement of the cam carrier 26.

In similar fashion, the cam carrier 26 can be moved into the second axial position by the second actuator 30. The displacement movement of the cam carrier 26 can then be dampened by the first actuator 28. For this, the fourth electrically operated 2-way valve 100 and the first mechanically operated 4-way valve 94 are switched appropriately.

When hydraulic fluid is ejected from the first actuator 28, the first check valve 88 prevents the hydraulic fluid flowing back to the fourth electrically operated 2-way valve 100. Likewise, the second check valve 90 prevents hydraulic fluid ejected from the second actuator 30 being taken to the third electrically operated 2-way valve 98.

The benefit of this exemplary embodiment lies in particular in that no separate damping cylinders or elastic elements need to be provided for the dampening of the axial displacement of the cam carrier 26.

Figure 5:
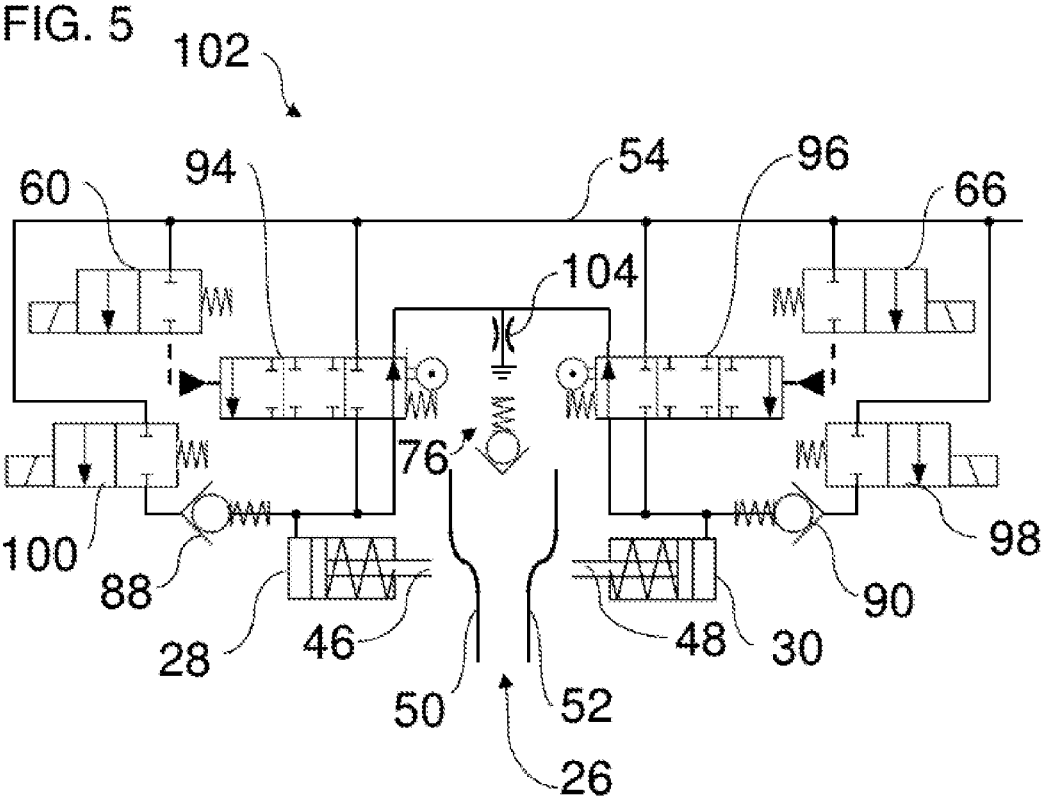
FIG. 5 shows a diagrammatic representation of yet another embodiment of the sliding cam system.

FIG. 5 shows another hydraulic system 102. The hydraulic system 102 differs from the hydraulic system 92 of FIG. 4 especially in that a common throttle 104 is provided instead of two separate throttles 84, 86. In addition, the valves 94, 96 have different neutral positions than in FIG. 4.

FIGS. 6 to 18 show another hydraulic system 106 with an exemplary configuration for the first actuator 28 and the second actuator 30. FIGS. 6 to 15 show the sequence of a displacement of the cam carrier 26 by the first actuator 28 toward the first axial position while the cam carrier 26 is turning together with the cam shaft 24 (see FIG. 1).

The hydraulic system 106 comprises a first electrically operated 2-way valve 108 and a second electrically operated 2-way valve 110. In addition, the hydraulic system 106 comprises a first control valve 112 and a second control valve 114 as well as a first check valve 116 and a second check valve 118. Furthermore, the hydraulic system 106 comprises the first throttle 84 and the second throttle 86.

Besides the pin 46, the first actuator 28 comprises a movable piston 120, a first movable bush 122, a second movable bush 124, a first elastic element 126, a second elastic element 128 and a third elastic element 130. The first elastic element 126 biases the piston 120 in a direction opposite that of the pin 46. The second elastic element 128 braces the pin 46 against the first bush 124. The third elastic element 130 biases the second bush 124 in a direction toward the piston 120. An axial movement of the pin 46 during the extending of the pin 46 is limited by the second bush 124. The pin 46 is led in the bushes 122, 124.

The second actuator 30 is built identically to the first actuator 28, with a piston 132, a first bush 134, a second bush 136, a first elastic element 138, a second elastic element 140 and a third elastic element 142.

Figure 6:
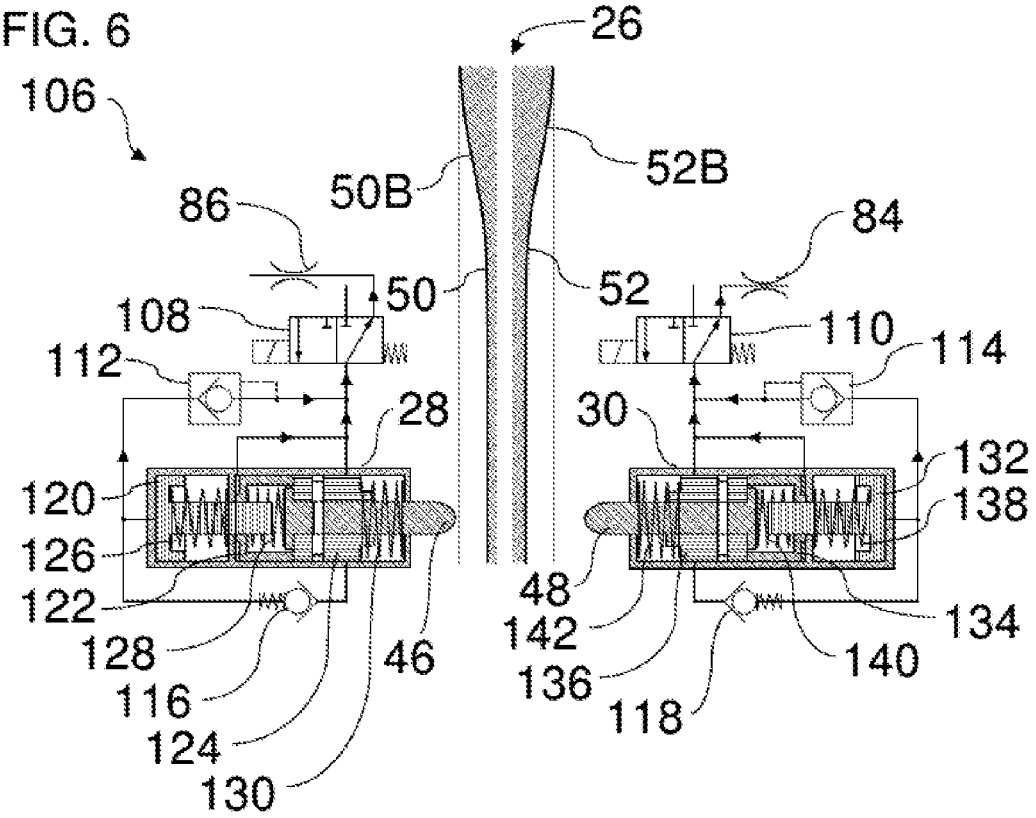
FIGS. 6 to 18 show diagrammatic representations of yet another embodiment of the sliding cam system to explain the functioning of an exemplary sliding cam system.

FIG. 6 shows the first actuator 28 and the second actuator 30 in a non-activated state. The pins 46 and 48 are retracted. The first and second electrically operated 2-way valves 108, 110 are switched such that hydraulic fluid is taken from the first actuator 28 and the second actuator 30 to a hydraulic fluid space of the internal combustion engine.

Figure 7:
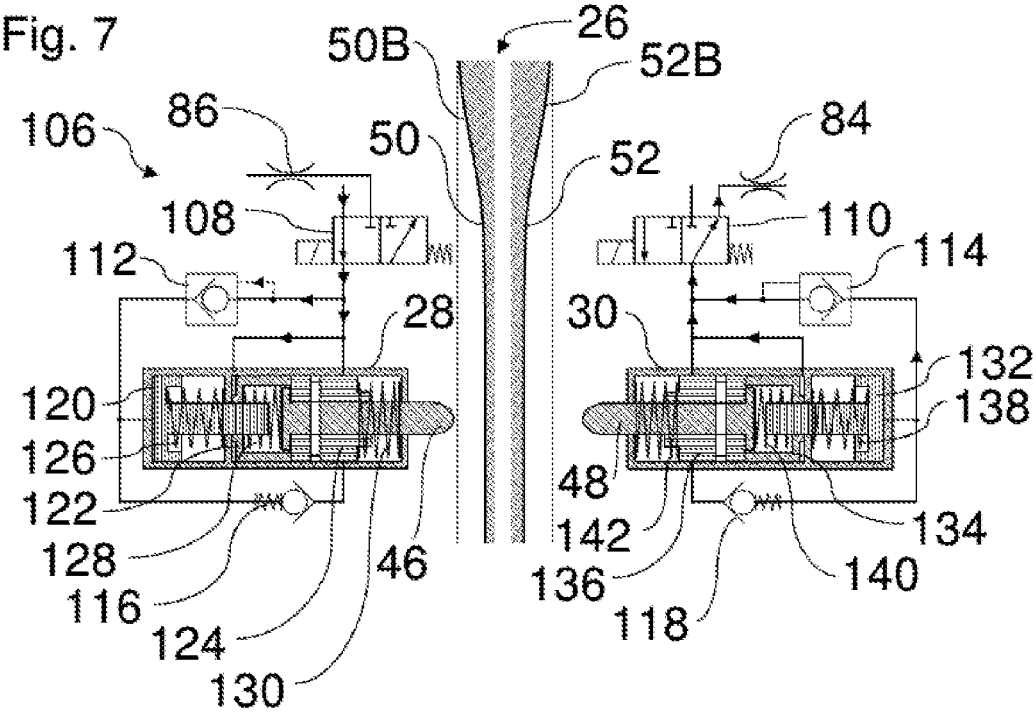

FIG. 7 shows the first actuator 28 at the start of an activation. The first electrically operated 2-way valve 108 allows hydraulic fluid to pass from a hydraulic fluid source. The hydraulic fluid is taken into a control fluid space for the displacing of the first bush 122.

Figure 8:
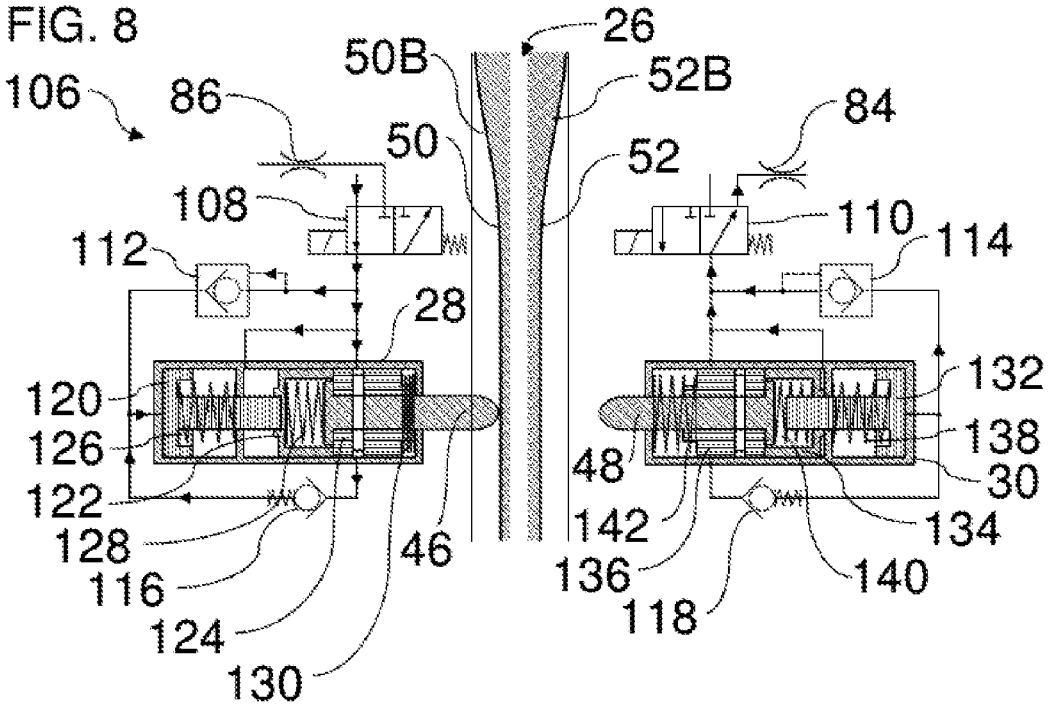

FIG. 8 shows that the hydraulic fluid taken into the control fluid space for the displacing of the first bush 122 has pushed the first bush 122 together with the second bush 124 and the pin 46 in the direction toward the actuator contact surface 50. The first bush 122, the second bush 124 and the pin 46 have been displaced against the biasing force of the third elastic element 130. The third elastic element 130 is compressed. The pin 46 touches the actuator contact surface 50 in an area in which the actuator contact surface 50 has the greatest distance from the first actuator 28.

Due to the displacement of the second bush 124 and the pin 46, a hydraulic channel of the second bush 124 is aligned with a hydraulic channel of the pin 46. The hydraulic channel of the second bush 124 and the hydraulic channel of the pin 46 produce a fluidic connection between the hydraulic fluid source and a control fluid space for the displacing of the piston 120. Hydraulic fluid flows through the hydraulic channels of the second bush 124 and the pin 46 to the control fluid space for the displacing of the piston 120.

Figure 9:
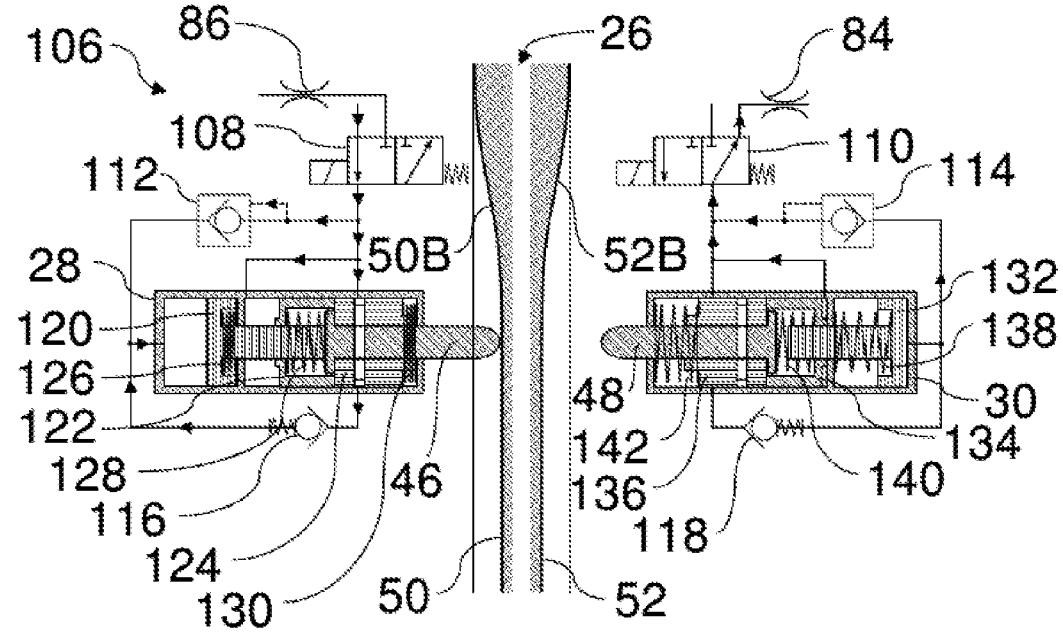

FIG. 9 shows that the hydraulic fluid taken into the control fluid space for the displacing of the first piston 120 has moved the piston 120 in a direction toward the actuator contact surface 50. The piston 120 has been moved against the biasing force of the first elastic element 126. The piston 120 contacts the pin 46, locking it.

Figure 10:
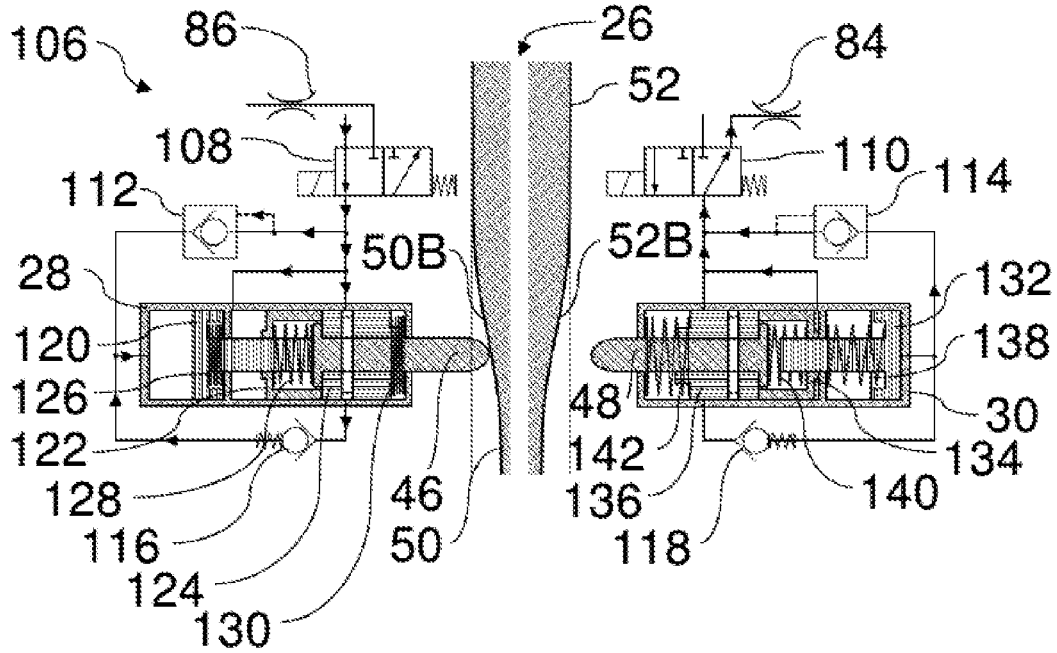
Figure 11:
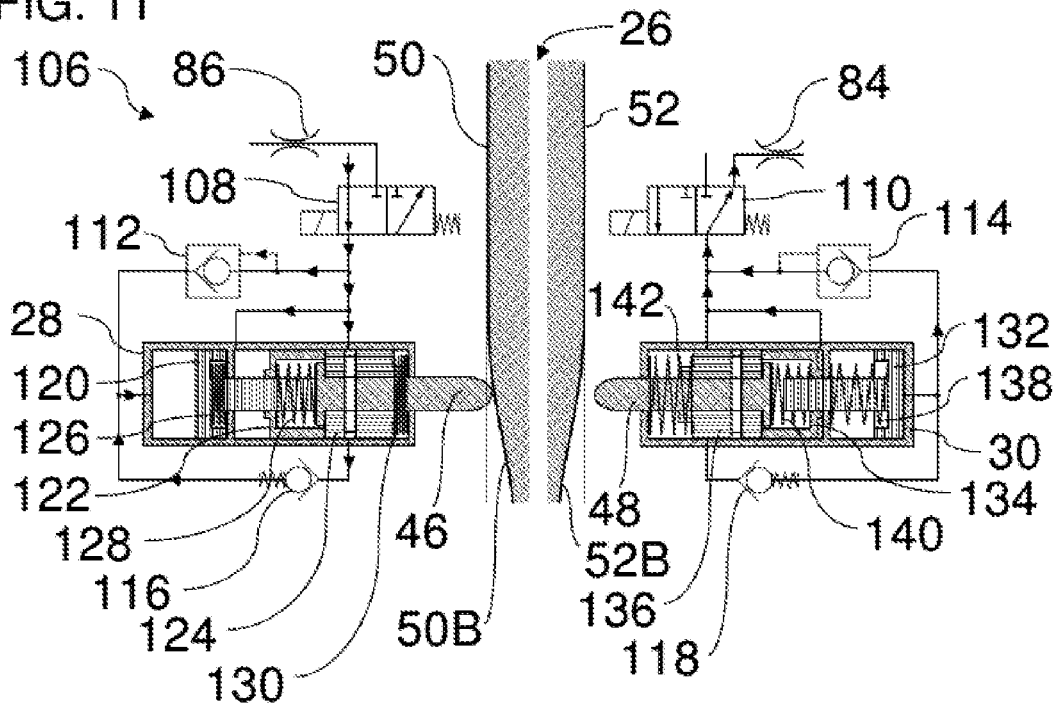

FIGS. 10 and 11 show that the pin 46 due to the rotation of the cam carrier 26 has finally ended up in engagement with the second ramp 50B. The pin 46 locked by the piston 120 pushes the cam carrier 26 in a direction toward the second actuator 30.

Figure 12:
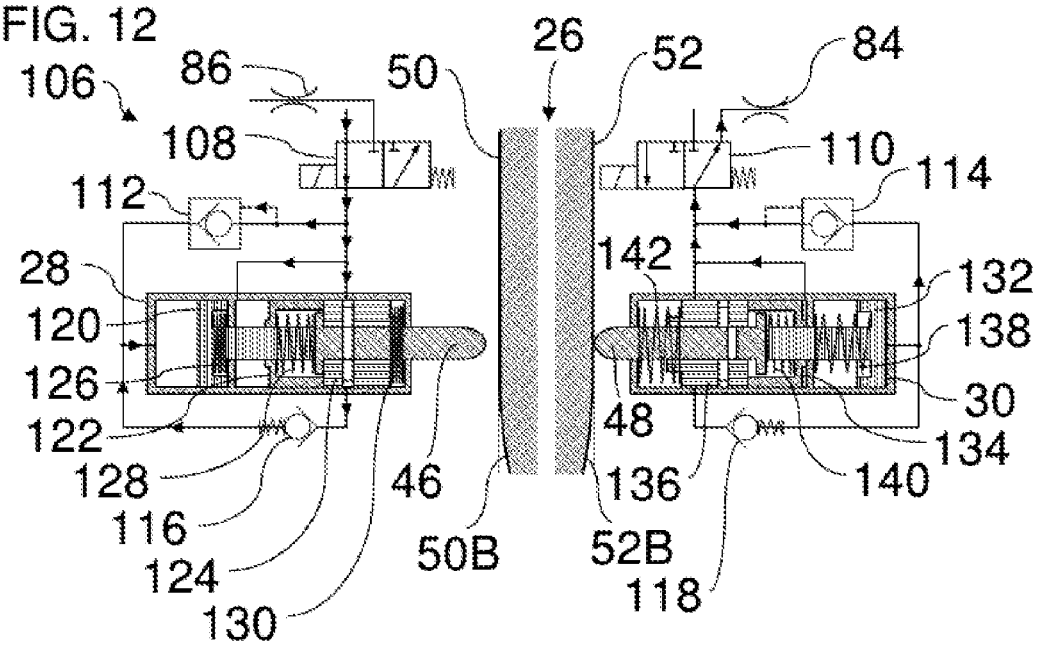

FIG. 12 shows that the cam carrier 26 at the end of the displacement movement produced by the first actuator 28 touches the pin 48 via the actuator contact surface 52. Due to the contact, the pin 48 is moved against the biasing force of the second elastic element 140 in the direction toward the piston 132 of the second actuator 30. In this way, a displacement movement of the cam carrier 26 is dampened.

Figure 13:
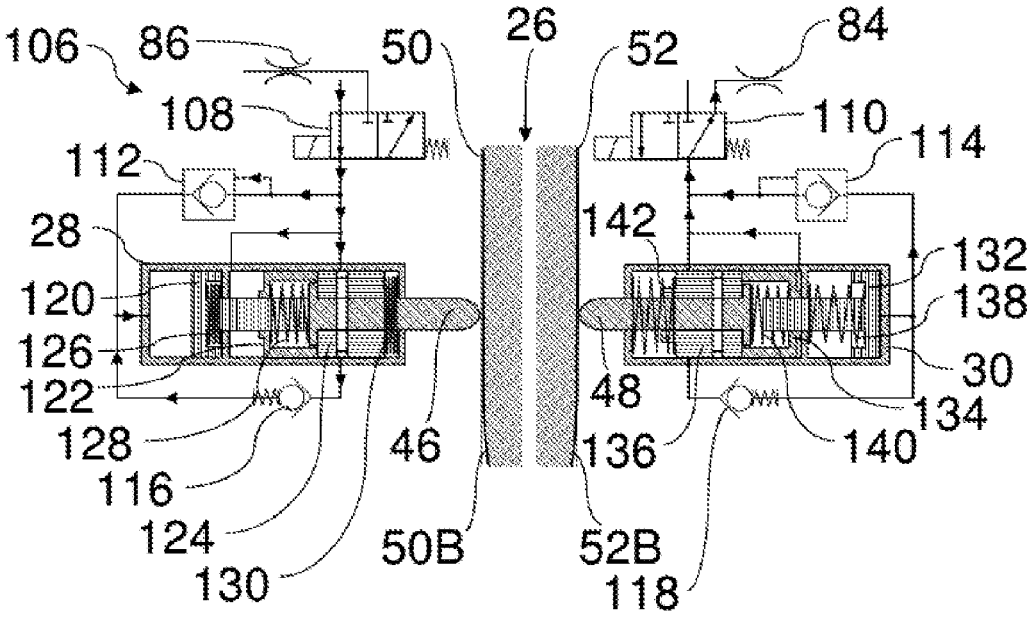

FIG. 13 shows that the biasing force of the second elastic element 140 has moved the pin 48 back to its starting position. The cam carrier 26 has been moved slightly as a result in the direction toward the first actuator 28. The cam carrier 26 now lies in the middle between the first actuator 28 and the second actuator 30. In this position, the arresting device 76 (cf. for example FIGS. 2 to 5) can secure the cam carrier 26 axially on the cam shaft 24 (see FIG. 1).

Figure 14:
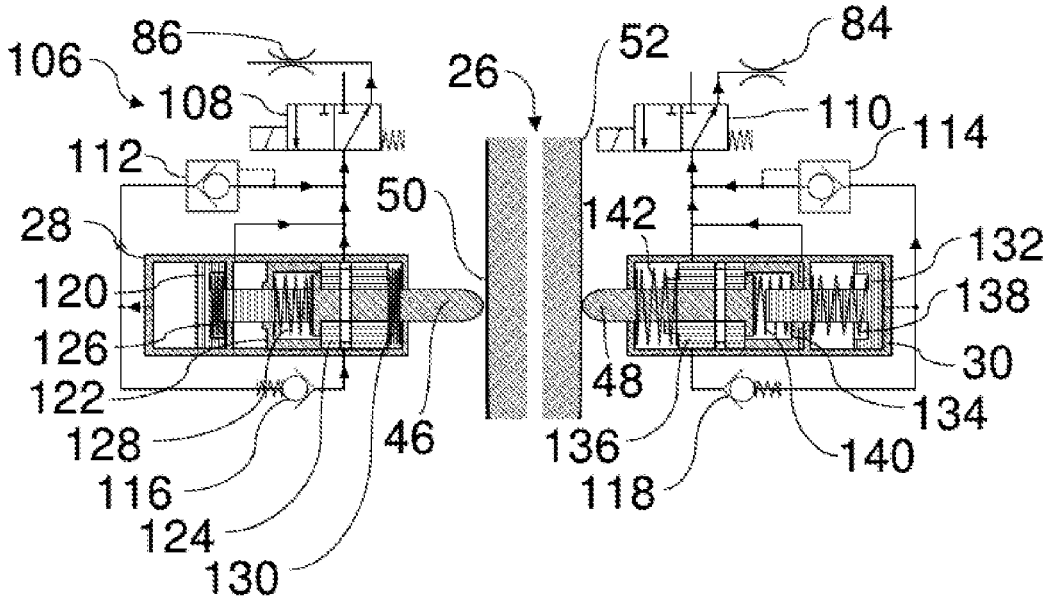

FIG. 14 shows that the first electrically operated 2-way valve 108 has been switched. The first electrically operated 2-way valve 108 produces a fluidic connection between the first actuator 28 and a hydraulic fluid space of the internal combustion engine via the first throttle 86. The hydraulic fluid from the control space for displacing of the piston 120 flows back through the hydraulic channels of the second bush 124 and the pin 46 in the direction of the first electrically operated 2-way valve 108. In addition, the hydraulic fluid from the control space for displacing of the piston 120 flows across the first control valve 112 in the direction of the first electrically operated 2-way valve 108. At the same time, hydraulic fluid flows from the control space for displacing of the first bush 128 in the direction of the first electrically operated 2-way valve 108.

Figure 15:
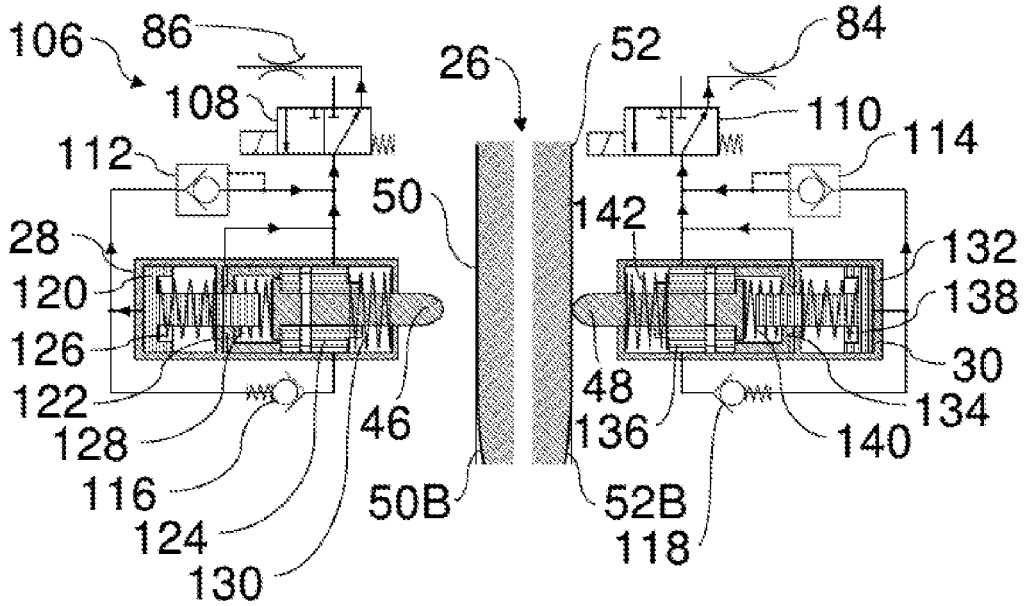

FIG. 15 shows that the outflowing of the hydraulic fluid has moved the piston 120 in a direction opposite that of the second actuator 30 by the biasing force of the first elastic element 126. In addition, the first bush 122, the second bush 124 and the pin 46 have been moved together opposite the second actuator 30 by the biasing force of the third elastic element 130. The pin 46 has retracted.

From the condition shown in FIG. 15, the cam carrier 26 can be moved back to the second axial position by activating the second actuator 30. The functioning of the second actuator 30 for this displacement is identical to that of the first actuator 28 for the displacement into the first axial position. The functioning of the first actuator 28 for the dampening of the displacement movement is likewise identical to that of the second actuator 30 during the dampening of the displacement into the first axial position.

Figure 16:
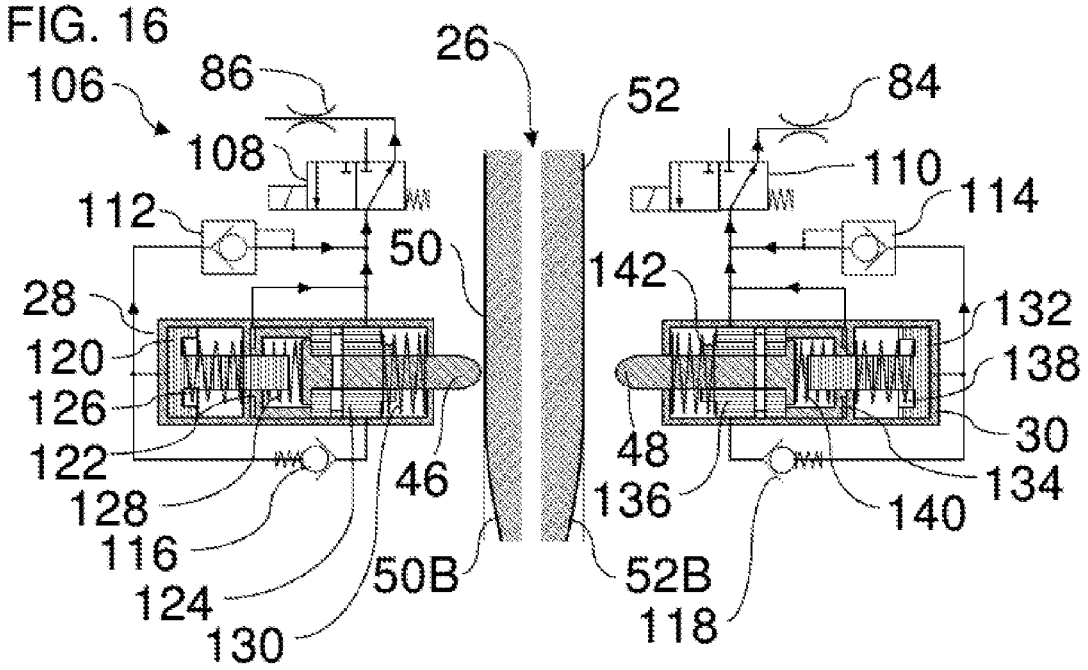
Figure 17:
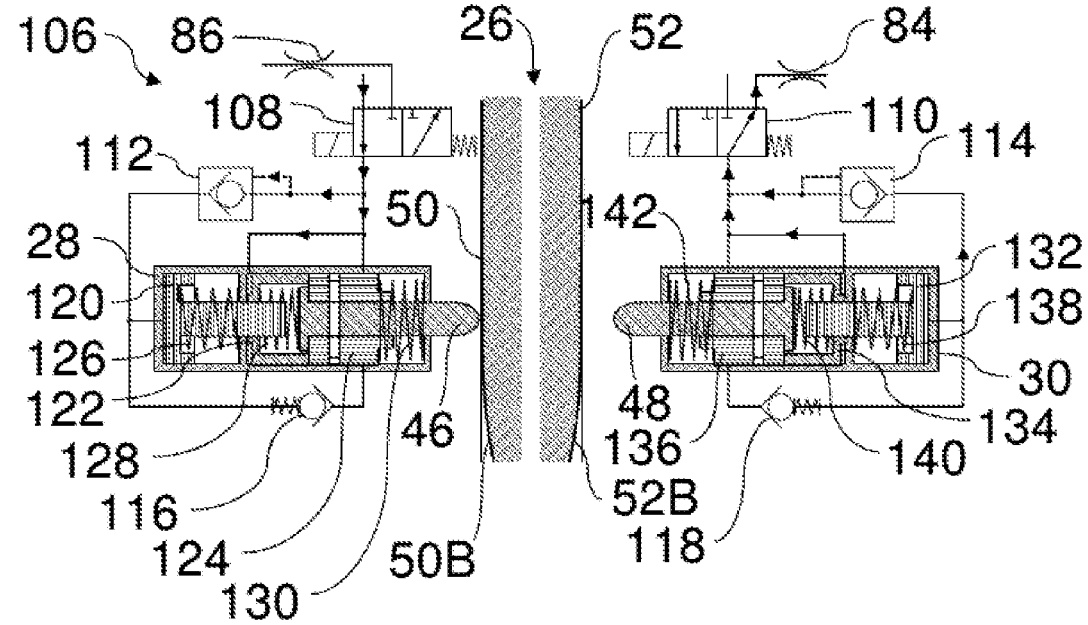
Figure 18:
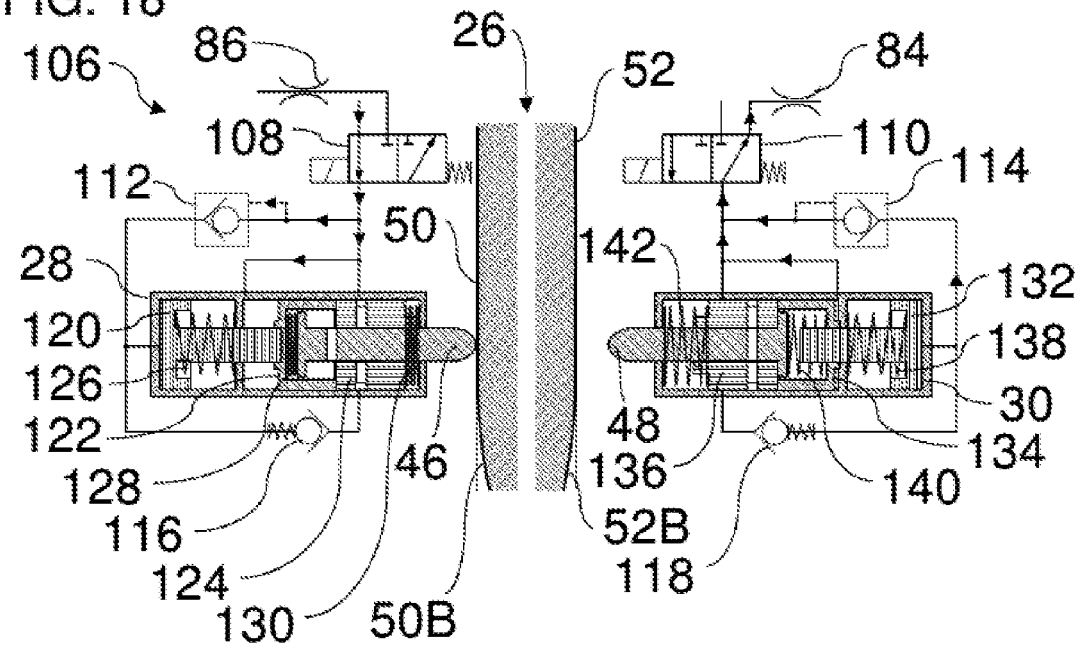

FIGS. 16 to 18 show that a displacement of the cam carrier 26 by the first actuator 28 is only carried out when the pin 46 is in engagement with the ramp 50B at maximum distance. No displacement of the cam carrier 26 occurs if the pin 46 is in engagement with the actuator contact surface 50 on the ramp 50B or outside of the ramp 50B.

FIG. 16 shows, similar to FIG. 6, the first actuator 28 and the second actuator 30 in a non-activated state. The pins 46 and 48 have been retracted. The first and second electrically operated 2-way valves 108, 110 have been switched so that hydraulic fluid is taken from the first actuator 28 and the second actuator 30 to a hydraulic fluid space of the internal combustion engine.

FIG. 17 shows the first actuator 28 at the start of an activation. The first electrically operated 2-way valve 108 allows hydraulic fluid to pass from a hydraulic fluid source. The hydraulic fluid is taken into a control fluid space for the displacing of the first bush 122. The pin 46 already lies against the actuator contact surface 50. That is, the pin 46 is touching the actuator contact surface 50 in an area in which the actuator contact surface 50 has the least distance from the first actuator 28.

FIG. 18 shows that the hydraulic fluid taken into the control fluid space for the displacing of the first bush 122 has pushed the first bush 122 together with the second bush 124 in the direction toward the actuator contact surface 50. However, the pin 46 here has not been moved with the first bush 122 and the second bush 124 in the direction of the actuator contact surface 50, since the pin 46 was already in contact with the actuator contact surface 50. The relative displacement between the first bush 122 and the pin 46 results in a compressing of the second elastic element 128. The hydraulic channels of the pin 46 and the second bush 124 are not aligned with each other. As a result, no fluidic connection is produced between the first electrically operated 2-way valve 108 and the control space for the displacing of the piston 120.

The pin 46 is only extended when it is in contact with the first ramp 50A (see FIG. 1) and with the area of the actuator contact surface 50 in which the actuator contact surface 50 has the greatest distance from the first actuator 28. In this way, it can be ensured that an axial displacement of the cam carrier 26 occurs only in the area of the base circle.

The present disclosure is not confined to the above described exemplary embodiments. Instead, many variants and modifications are possible, likewise making use of the notion of the present disclosure and therefore coining within the scope of protection.

LIST OF REFERENCE SYMBOLS

10 Variable valve train
12 Gas exchange valve
14 Gas exchange valve
16 Sliding cam system
18 Force transmission device
20 First bearing block
22 Second bearing block
24 Cain shaft
26 Cam carrier
28 First actuator
30 Second actuator
32 First cam
34 Second cam
36 First shifting gate
38 Second shifting gate
40 Rocker arm
42 Rocker arm axis
44 Cam follower
46 Pin
48 Pin
50 Actuator contact surface
50A First ramp
50B Second ramp
52 Actuator contact surface
52A First ramp
52B Second ramp
53 Hydraulic system
54 Main hydraulic line
56 First connection line
58 Second connection line
60 First electrically operated valve
62 First mechanically operated valve
64 First control valve
66 Second electrically operated valve
68 Second mechanically operated valve
70 Second control valve
72 First elastic element
74 Second elastic element
76 Arresting device
78 Hydraulic system
80 First damping cylinder
82 Second damping cylinder
84 First throttle
86 Second throttle

88 First check valve
90 Second check valve
92 Hydraulic system
94 First mechanically operated 4-way valve
96 Second mechanically operated 4-way valve
98 Third electrically operated 2-way valve
100 Fourth electrically operated 2-way valve
102 Hydraulic system
104 Common throttle
106 Hydraulic system
108 First electrically operated 2-way valve
110 Second electrically operated 2-way valve
112 First control valve
114 Second control valve
116 First check valve
118 Second check valve
120 Piston
122 First bush
124 Second bush
126 First elastic element
128 Second elastic element
130 Third elastic element
132 Piston
134 First bush
136 Second bush
138 First elastic element
140 Second elastic element
142 Third elastic element

We claim:

1. A sliding cam system for an internal combustion engine, comprising:

a cam shaft;

a cam carrier, which is arranged rotationally fixed and axially movably on the cam shaft, wherein the cam carrier comprises a first shifting gate and a second shifting gate, wherein an axial displacement of the cam carrier is dampened hydraulically or by an elastic element;

a first actuator with an element able to move along a longitudinal axis of the cam shaft, which can be brought into contact wit the first shifting gate for the axial movement of the cam carrier in a first direction; and a second actuator with a second element able to move along the longitudinal axis of the cam shaft, which can be brought into contact with the second shifting gate for the axial movement of the cam carrier in a second direction which is opposite to the first direction.

2. The sliding cam system according to claim 1, wherein the element able to move along the axis of the cam shaft is a pin.

3. The sliding cam system according to claim 1, wherein the second element able to move along the axis of the cam shaft is a pin.

4. The sliding cam system according to claim 1, wherein:

the first actuator is received in or on a first bearing block, which supports the cam shaft in a rotating manner; or the second actuator is received in or on a second bearing block, which supports the cam shaft in a rotating manner.

5. The sliding cam system according to claim 1, wherein:

the first shifting gate or the second shifting gate has a steplike configuration; or the first shifting gate is arranged at a first end of the cam carrier and the second shifting gate is arranged at an opposite second end of the cam carrier.

6. The sliding cam system according to claim 1, wherein:

the first shifting gate comprises an actuator contact surface, which extends in a circumferential direction about the longitudinal axis of the cam shaft; or the second shifting gate comprises an actuator contact surface, which extends in a circumferential direction about the longitudinal axis of the cam shaft.

7. The sliding cam system according to claim 6, wherein:

the actuator contact surface of the first shifting gate comprises a first ramp and a second ramp, wherein the first ramp of the actuator contact surface of the first shifting gate increases a distance between the first actuator and the actuator contact surface of the first shifting gate relative to a rotary direction of the cam shaft and the second ramp of the actuator contact surface of the first shifting gate decreases a distance between the first actuator and the actuator contact surface of the first shifting gate relative to the rotary direction of the cam shaft; or the actuator contact surface of the second shifting gate comprises a first ramp and a second ramp, wherein the first ramp of the actuator contact surface of the second shifting gate increases a distance between the second actuator and the actuator contact surface of the second shifting gate relative to a rotary direction of the cam shaft and the second ramp of the actuator contact surface of the second shifting gate decreases a distance between the second actuator and the actuator contact surface of the second shifting gate relative to the rotary direction of the cam shaft.

8. The sliding cam system according to claim 1, wherein the first actuator or the second actuator is hydraulically, electrically or pneumatically operated.

9. The sliding cam system according to claim 1, further comprising:

a first elastic element, which biases the cam carrier in the second direction; or a second elastic element, which biases the cam carrier in the first direction.

10. The sliding cam system according to claim 9, wherein:

the first elastic element supports the cam carrier on a bearing block for the rotary mounting of the cam shaft and is mounted rotatably about the longitudinal axis of the cam shaft relative to the bearing block or the cam carrier; or the second elastic element supports the cam carrier on a bearing block for the rotary mounting of the cam shaft and is mounted rotatably about the longitudinal axis of the cam shaft relative to the bearing block or the cam carrier.

11. The sliding cam system according to claim 1, further comprising:

a first hydraulic damping cylinder, which is disposed to dampen an axial displacement of the cam carrier in the first direction; or a second hydraulic damping cylinder, which is disposed to dampen an axial displacement of the cam carrier in the second direction.

12. The sliding cam system according to claim 11, further comprising:

a first throttle, which is arranged downstream from the first hydraulic damping cylinder. Or a second throttle, which is arranged downstream from the second hydraulic damping cylinder.

13. The sliding cam system according to claim 1, wherein:

the second actuator dampens axial displacement of the cam carrier when the first actuator moves the cam carrier axially in the first direction; or the first actuator dampens axial displacement of the cam carrier when the second actuator moves the cam carrier axially in the second direction.

14. The sliding cam system according to claim 13, wherein:

the second actuator dampens the axial displacement of the cam carrier hydraulically or by an elastic element of the second actuator; or the first actuator dampens the axial displacement of the cam carrier hydraulically or by an elastic element of the first actuator.

15. A variable valve train for an internal combustion engine, comprising:

a sliding cam system including, a cam shaft;

a cam carrier, which is arranged rotationally fixedly and axially movably on the cam shaft, wherein the cam carrier comprises a first shifting gate and a second shifting gate, wherein an axial displacement of the cam carrier is dampened hydraulically or by an elastic element;

a first actuator with an element able to move along a longitudinal axis of the cam shaft, which can be brought into contact with the first shifting gate for the axial movement of the cam carrier in a first direction;

a second actuator with a second element able to move along the longitudinal axis of the cam shaft, which can be brought into contact with the second shifting gate for the axial movement of the cam carrier in a second direction which is opposite to the first direction;

at least one gas exchange valve; and a force transmission device, which in dependence on an axial position of the cam carrier optionally places a first cam of the cam carrier in an operative connection with the at least one gas exchange valve or places a second cam of the cam carrier in an operative connection with the at least one gas exchange valve.

16. A motor vehicle, comprising:

a sliding cam system including, a cam shaft;

a cam carrier, which is arranged rotationally fixedly and axially movably on the cam shaft, wherein the cam carrier comprises a first shifting gate and a second shifting gate, wherein an axial displacement of the cam carrier is dampened hydraulically or by an elastic element;

a first actuator with an element able to move along a longitudinal axis of the cam shaft, which can be brought into contact with the first shifting gate for the axial movement of the cam carrier in a first direction;

a second actuator with a second element able to move along the longitudinal axis of the cam shaft, which can be brought into contact with the second shifting gate for the axial movement of the cam carrier in a second direction which is opposite to the first direction;

at least one gas exchange valve; and a force transmission device, which in dependence on an axial position of the cam carrier optionally places a first cam of the cam carrier in an operative connection with the at least one gas exchange valve or places a second cam of the cam carrier in an operative connection with the at least one gas exchange valve.

17. The motor vehicle of claim 16, wherein the motor vehicle is a utility vehicle.

* * * * *